United States Patent [19]

Gupta et al.

[11] Patent Number: 4,691,081

[45] Date of Patent: Sep. 1, 1987

[54] ELECTRICAL CABLE WITH IMPROVED METALLIC SHIELDING TAPE

[75] Inventors: Chakra V. Gupta; Brian D. Garrett, both of Conover, N.C.

[73] Assignee: Comm/Scope Company, Catawba, N.C.

[21] Appl. No.: 852,776

[22] Filed: Apr. 16, 1986

[51] Int. Cl.[4] ..... H01B 7/34

[52] U.S. Cl. ..... 174/105 R; 174/36; 174/107; 428/461; 428/462

[58] Field of Search ..... 174/36, 105 R, 107; 428/461, 462

[56] References Cited

U.S. PATENT DOCUMENTS

| | | | |
|---|---|---|---|
| 3,085,908 | 4/1963 | Morehouse | 428/450 X |
| 3,233,036 | 2/1966 | Jachimowicz | 174/107 |
| 3,445,326 | 5/1969 | Hurst | 428/341 |
| 3,647,617 | 3/1972 | Rieke et al. | 428/220 |
| 3,706,592 | 12/1972 | Thomson | 428/251 |
| 3,721,597 | 3/1973 | Colburn | 156/31 B |
| 3,783,012 | 1/1974 | Morita et al. | 428/462 |
| 3,903,354 | 9/1975 | Dagefoerde | 174/107 |
| 4,010,315 | 3/1977 | Mildner | 174/107 |
| 4,092,452 | 5/1978 | Hori et al. | 174/107 X |
| 4,125,739 | 11/1978 | Bow | 174/107 X |
| 4,157,452 | 6/1979 | Pignataro et al. | 174/36 |
| 4,323,721 | 4/1982 | Kincaid et al. | 174/36 |
| 4,327,246 | 4/1982 | Kincaid | 174/36 |
| 4,327,248 | 4/1982 | Campbell | 174/107 |
| 4,423,117 | 12/1983 | Machonis, Jr. et al. | 428/461 X |
| 4,440,911 | 4/1984 | Inoue et al. | 428/461 X |
| 4,449,014 | 5/1984 | Brezinsky | 174/107 |
| 4,454,379 | 6/1984 | Cleveland et al. | 174/107 |
| 4,477,693 | 10/1984 | Krabec et al. | 174/105 R X |
| 4,501,928 | 2/1985 | Ishitobi | 174/107 |
| 4,515,992 | 5/1985 | Gupta | 174/107 X |

FOREIGN PATENT DOCUMENTS

| | | | |
|---|---|---|---|
| 23032 | 8/1979 | Japan | 428/462 |

*Primary Examiner*—Morris H. Nimmo

*Attorney, Agent, or Firm*—Bell Seltzer, Park & Gibson

[57] ABSTRACT

The cable shielding tape of this invention comprises a metal foil layer and a polymer supporting layer fusibly bonded directly to the aluminum foil layer and serving to structurally reinforce the foil layer. The polymer supporting layer comprises a polymer blend of a polyolefin component and an elastomeric component.

30 Claims, 4 Drawing Figures

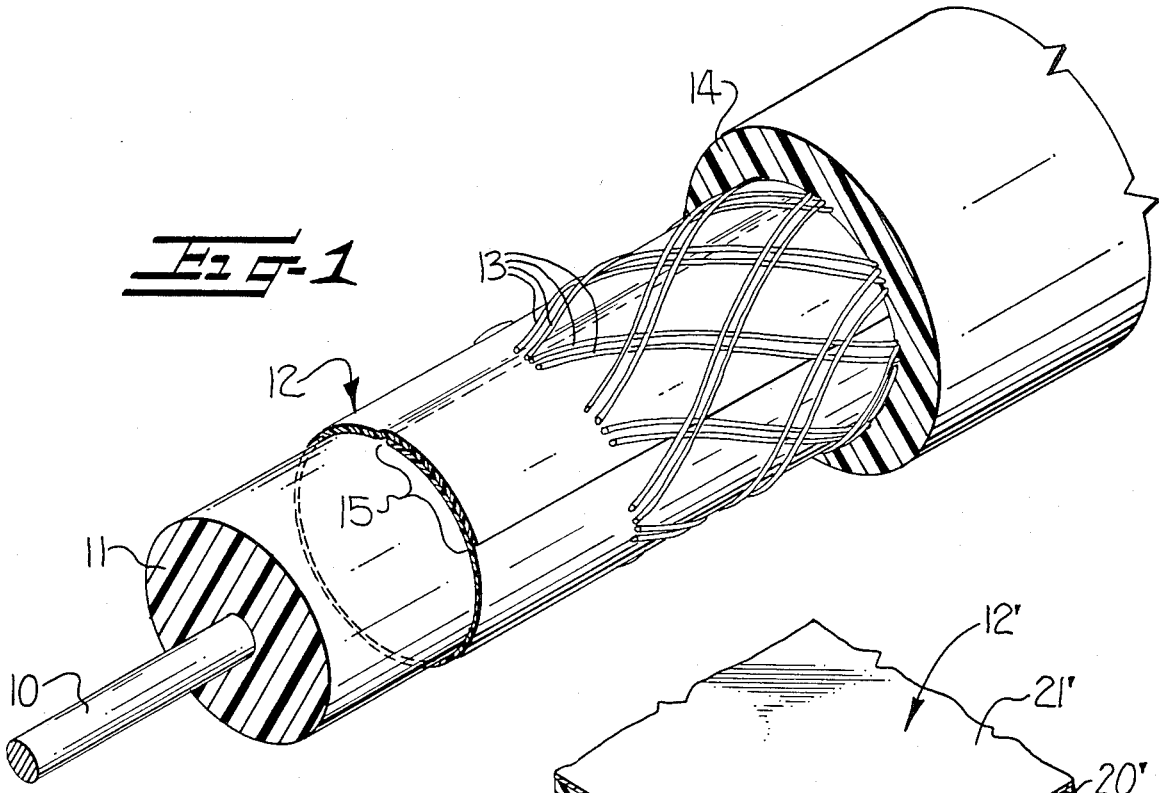
Fig-1
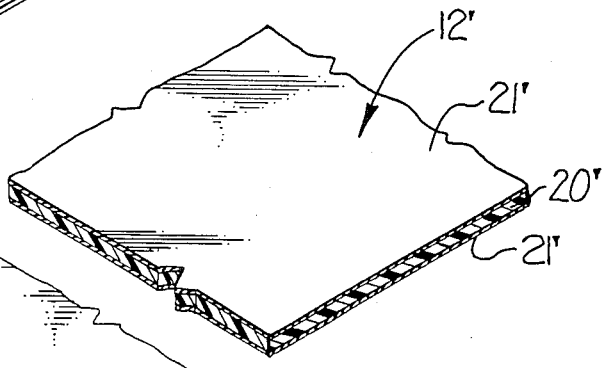
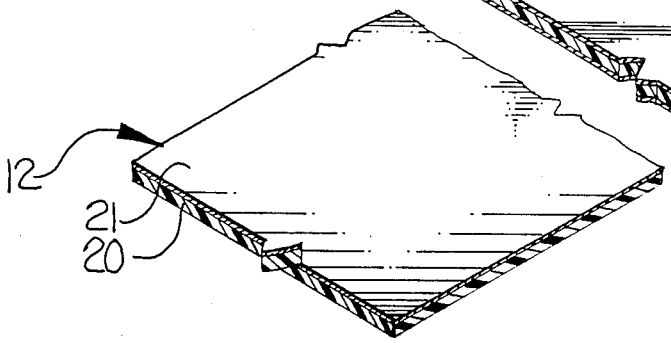
Fig-4
Fig-2
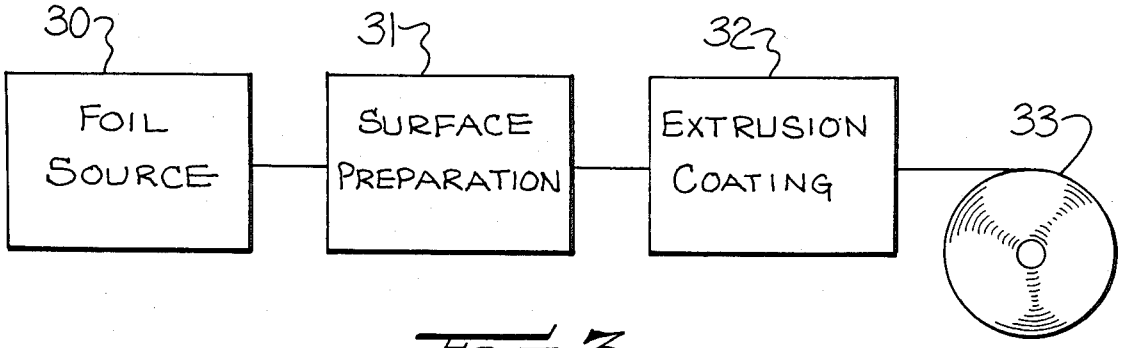
Fig-3

ELECTRICAL CABLE WITH IMPROVED METALLIC SHIELDING TAPE

FIELD AND BACKGROUND OF THE INVENTION

This invention relates to shielded electrical cables generally, and particularly relates to a cable which has an improved metal foil shielding tape therein.

Cables of the type used to transmit high frequency signals (such as radio and television signals) usually have one or more inner conductors formed of copper or copper-clad aluminum, with the inner conductor or conductors being insulated by a dielectric material such as expanded or unexpanded polyethylene. The dielectric material, in turn, is surrounded by a metallic outer conductor. The metallic outer conductor, in addition to serving as an electrical conductor, also serves to shield the cable against leakage of radio frequency radiation. Cables of the type which employ a metallic foil as the outer conductor typically utilize a foil tape wrapped around the dielectric and bonded thereto by an adhesive. Typically, the adhesive is applied as a coating on one surface of the foil.

It is well recognized that any crimping, folding or bending of the metallic outer conductor layer is highly deleterious to the cable. Not only may such disruptions allow ingress of moisture into the cable, but they also significantly interfere with the R.F. propagation characteristics of the cable. Even a relatively small, microscopic disruption of these surfaces, as would occur from microbending, decreases the signal propagating properties of the cable.

Accordingly, one approach to this problem has been to make the metal foil layer relatively thick in order to provide the needed strength and integrity and to provide a thin coating of adhesive on the surface for bonding to the cable. However, the thickness, stiffness and cost of this type of shielding tape make it undesirable for many applications.

To overcome these limitations, the most popular approach has been to form the shielding tape of a multilayered laminated construction, comprised of one or more relatively thin metallic foil layers and additional adhesive and/or polymer film layers. By way of example, one such multilayered shielding tape disclosed in U.S. Pat. No. 3,721,597 consists of an inner thermoplastic film having foil layers adhesively bonded to the opposing surfaces thereof. While these types of shielding tapes offer some advantages over the earlier thick metal shielding tapes, their complexity of construction dictates that they are relatively expensive.

In the aforementioned shielding tapes an adhesive is used for bonding the metal foil to the cable dielectric, and shielding tapes of laminated construction also use adhesives to bond together the various layers. The adhesive most commonly used for these purposes has been a copolymer of ethylene and acrylic acid, since the ethylene acrylic acid (EAA) adhesive will effectively bond both to metal surfaces and to polyolefin surfaces.

Unfortunately, while EAA adhesives have excellent structural bonding properties, they have poor electrical properties. EAA adhesives contain a large number of polar carboxyl groups, which produce increased electrical dissipation in the cable at the high frequencies of the signals carried by the cable. In recognition of this problem, in commercial practice, the dissipation or loss contributed by the EAA adhesive is minimized by applying the minimum possible thickness of EAA adhesive to the foil. However, even at these minimal levels, the effect of the EAA adhesive is measurable.

SUMMARY OF THE INVENTION

The present invention departs fundamentally from the approaches which have heretofore ordinarily been used in the construction of metallic shielding tapes. In the present invention, a relatively thin aluminum foil shielding layer which, by itself, might not have adequate strength to resist disruptions or microbending is bonded directly to a relatively thick polymer supporting layer. The supporting layer serves to structurally reinforce the foil layer and prevent unwanted disruptions in the foil and is formed of a polymer material which will not deleteriously affect the electrical properties of the cable. Furthermore, the polymer supporting layer has heat sealable properties which will allow the metallic foil layer to be bonded directly to the cable dielectric without the need for a highly polar and electrically poor EAA adhesive as is conventional. In addition to the improved electrical properties. the present invention provides significant cost advantages by providing a simple structure with relatively few layers.

In summary, the present invention, in one aspect, is directed to a heat sealable metallic shielding tape, useful for the construction of electrical cables, which is constructed of a metal foil layer bonded directly to a heat sealable polymer supporting layer. The polymer supporting layer comprises a polymer blend of a polyolefin component and an elastomer component. The polyolefin has excellent strength properties but is not, by itself, heat sealable. The elastomer imparts heat sealability and other desirable properties to the polymer blend. The invention is also directed to an electrical cable prepared with such a shielding tape.

BRIEF DESCRIPTION OF THE DRAWINGS

Some of the features and advantages of the invention having been stated, others will become apparent as the description proceeds, when taken in connection with the accompanying drawings, in which:

FIG. 1 is a perspective view showing one form of a coaxial cable in accordance with the invention with parts broken away for clarity.

FIG. 2 is an enlarged perspective view of a shielding tape in accordance with the invention.

FIG. 3 is a block schematic illustration of an apparatus and process for producing the shielding tape.

FIG. 4 is an enlarged perspective view of another embodiment of a shielding tape in accordance with the invention.

DETAILED DESCRIPTION

Turning to FIG. 1, an electric cable of the present invention will be seen to comprise a metallic inner conductor 10, dielectric 11, a heat sealable metallic shielding tape 12, and a polymeric outer jacket 14. In the particular embodiment illustrated, the cable also includes a metallic wire braid 13 surrounding the cable to further shield and protect the cable. The dielectric 11 is preferably a polyolefin dielectric such as a foamed polyethylene. The shielding tape 12 surrounds the dielectric and is preferably heat sealed thereto, with the longitudinal edge portions of the tape overlapping and sealed together to form a joined segment 15 so that the tape completely envelopes the dielectric.

In FIG. 2, the shielding tape 12 will be seen to be comprised of a thin aluminum foil layer 21 bonded to a heat sealable polymer supporting layer 20. The heat sealable nature of the polymer fusibly bonds the polymer supporting layer directly to the aluminum foil layer such that a separate adhesive layer is unnecessary. The foil layer is preferably not more than about 0.003 inches thick, and is most preferably about 0.001 inches thick. The supporting layer 20 is preferably not less than about 0.0003 inches thick, and may suitably be about 0.001 inches thick. One particular advantage of the present invention is that, instead of using multiple layers of extremely thin aluminum, a single layer of aluminum having a thickness equivalent to the combined thickness of aluminum in a more complex layered structure can be used. As a result, the aluminum layer used in the present invention has much improved handling characteristics.

The supporting layer 20 is comprised of a polymer blend of a polyolefin strength component and an elastomeric heat sealable adhesive component. In the polymer blend, the two components are intimately admixed, and each component contributes certain desirable properties or characteristics to the blend. The polyolefin strength component is a high modulus polymer and provides good strength properties so that the blend can perform its suppporting function for the foil layer. However, the polyolefin component, individually, is not heat sealable. The elastomeric component is of significantly lower modulus and would not, individually, provide adequate structural support for the foil. However, the elastomeric component, when blended with the polyolefin strength component, imparts excellent heat sealability to the blend while retaining the good strength properties of the polyolefin component.

The polyolefin strength component may be comprised of any suitable polyolefin, and preferably forms at least 40% by weight of the blend. Preferred are polyethylene and polypropylene, with polyethylene particularly preferred. For example, one suitable polyolefin is a high density polyethylene (density=0.96) with a melt index of about 8.0 gm/10 min. and a flexural modulus of about 250,000 psi. Such polyolefin polymers are commercially available from various manufacturers.

The elastomeric heat sealable adhesive component is an elastomeric polymer with good heat sealable adhesive properties and a compatibility suitable for blending with the polyolefin strength component. The elastomer component comprises at least 1% and up to about 20% by weight of the polymer blend. Preferred elastomer materials are polyisoprene and polyisobutylene, with polyisobutylene most preferred. These elastomers can either be blended directly with the strength component, or, more conveniently, obtained in the form of a commercially available extrudable polyisoprene-modified polyolefin or polyisobutylene-modified polyolefin resins of the type conventionally marketed for use as extrudable polyolefin adhesives. One suitable such adhesive is a commercially available polyisobutylene-modified high density polyethylene resin having a density of 0.94 gm/cc, a melt index of 6.0 gm/10 min. and a Vicat softening point of 123° C.

Other ingredients may advantageously be included in the polymer blend, as those skilled in the art will readily appreciate. To improve the resilience and elasticity of the polymer blend, the blend may additionally include, for example, up to about 45% of a linear low density polyethylene. One suitable such polymer has a melt index of about 0.8 gm/10 min. and a density of 92 gm/cc, and an elongation of about 700%.

A specific example of one suitable polymer alloy was comprised of 50% high density polyethylene (density=96 gm/cc MI=8.0 gm/10 min.), 35% linear low density polyethylene (density=0.92 gm/cc MI=0.8 gm/10 min.), and 15% polyisobutylene-modified high density polyethylene resin (density=0.94 gm/cc MI=6.0 gm/10 min.).

A preferred method for manufacturing a metallic shielding tape of the type shown in FIG. 2 is set forth in FIG. 3. A foil source 30 provides aluminum foil to a surface preparation step 31, where the surface of the foil to which the supporting layer is to be fusibly bonded is surface treated with a reducing agent. This renders the surface substantially free of aluminum oxides, and enhances the bonding of the supporting layer to the foil layer. We treated the surface of our aluminum foil layer by washing it with an organic solvent containing an aminoalkyl silane monomer. These silane compounds are described in U.S. Pat. No. 3,085,908 to Morehouse, but other suitable reducing agents could also be used.

After the surface treatment, the aluminum foil layer proceeds directly to an extrusion coating step 32, where the polymer supporting layer is extruded directly onto the aluminum foil layer to form the finished tape, which is then collected in roll form 33 for later use in the manufacture of a finished cable.

It will be seen that in the shielding tape 12 of FIG. 2, the heat sealable polymer supporting layer 20 forms one of the faces of the tape. This tape may be fusibly bonded to a substrate, such as the polyolefin cable dielectric 11 for example, by heating the shielding tape sufficiently to thermally activate the heat sealable properties of the polymer supporting layer 20. This may be accomplished, for example, by the heat from the application of the extrusion coated insulating jacket 14.

For those particular applications where heat sealing of the shielding tape is not required, an additional layer of foil or film may be fusibly bonded to the supporting layer. The shielding tape embodiment shown in FIG. 4 is essentially the same as that shown in FIG. 2 except that an additional foil layer 21' has been bonded to the supporting layer 20' so that the supporting layer 20' is located in the middle and the opposing faces of the shielding tape 12' are defined by the foil layers 21'.

The foregoing embodiments are to be considered illustrative rather than restrictive of the invention, and those modifications which come within the meaning and range of equivalents of the claims are to be included therein.

That which is claimed is:

1. A cable comprising at least one metallic inner conductor, a dielectric material surrounding the at least one inner conductor, and a metallic shielding tape surrounding the dielectric material and the at least one inner conductor, said shielding tape comprising a metal foil layer and a heat sealable polymer supporting layer fusibly bonded directly to said foil layer and serving to structurally reinforce the foil layer and prevent unwanted disruptions in the foil which would adversely affect the signal propagating properties of the cable, said polymer supporting layer comprising a polymer blend of a non-heat sealable polyolefin strength component and an elastomeric heat sealable adhesive component.

2. A cable as claimed in claim 1, wherein said polyolefin component is selected from the group consisting of polyethylene or polypropylene.

3. A cable as claimed in claim 1, wherein said elastomeric component is selected from the group consisting of polyisoprene, polyisobutylene, or mixtures thereof.

4. A cable as claimed in claim 1, wherein the surface of said foil to which the polymer supporting layer is fusibly bonded has been surface treated to render it substantially free of aluminum oxides for enhanced bonding with said polymer supporting layer.

5. A cable as claimed in claim 1, wherein said polymer supporting layer is present on one face of the shielding tape and is fusibly bonded to said dielectric material.

6. A cable as claimed in claim 1, wherein said foil layer forms one face of the shielding tape and the shielding tape includes an additional metal foil layer fusibly bonded to said polymer supporting layer and forming the opposite face of the shielding tape.

7. A cable comprising at least one metallic inner conductor, a dielectric material surrounding the at least one inner conductor, and a metallic shielding tape surrounding the dielectric material and the at least one inner conductor, said shielding tape comprising an aluminum foil layer and a polymer blend supporting layer fusibly bonded directly to said aluminum foil layer and serving to structurally reinforce the aluminum foil layer, the polymer blend supporting layer comprising a non-heat sealable polyolefin strength component and an elastomeric adhesive component selected from the group consisting of polyisoprene, polyisobutylene, or mixtures thereof imparting heat sealable properties to the polymer blend.

8. A cable as claimed in claim 7, wherein said polyolefin strength component is selected from the group consisting of polyethylene or polypropylene.

9. A cable as claimed in claim 8 wherein said polymer blend comprises high density polyethylene, linear low density polyethylene and polyisobutylene.

10. A cable comprising at least one metallic inner conductor, a polyolefin dielectric material surrounding the at least one inner conductor, and a heat sealable metallic shielding tape sealed to and surrounding the dielectric material and the at least one inner conductor, said shielding tape comprising an aluminum foil layer, one surface of which has been surface treated to render it substantially free of aluminum oxides for enhanced bonding, and a heat sealable polymer supporting layer fusibly bonded directly to said surface treated surface of the aluminum foil to structurally reinforce the foil layer and prevent unwanted disruptions which would adversely affect the signal propagating properties of the cable, and said heat sealable polymer supporting layer also being bonded to said polyolefin dielectric, and wherein said polymer supporting layer comprises a polymer blend of a non-heat sealable polyolefin component and an elastomer component imparting heat sealable properties to the polymer blend.

11. A cable comprising at least one metallic inner conductor, a dielectric material surrounding the at least one inner conductor, and a metallic shielding tape surrounding the dielectric material and the at least one inner conductor, said shielding tape comprising an aluminum foil layer of a thickness of no more than about 0.003 inch and a polymer blend supporting layer fusibly bonded directly to said aluminum foil layer and serving to structurally reinforce the aluminum foil layer, the polymer blend supporting layer comprising at least 40% non-heat sealable high density polyethylene, at least 1% of an elastomer selected from the group consisting of polyisoprene, polyisobutylene, or mixtures thereof, and up to 45% non-heat sealable linear low density polyethylene.

12. A metallic shielding tape useful for the preparation of shielded cable, said shielding tape comprising a metal foil layer and a heat sealable polymer supporting layer fusibly bonded directly to said foil layer and serving to structurally reinforce the foil layer and prevent unwanted disruptions in the foil which would adversely affect the signal propagating properties of the cable, said polymer supporting layer comprising a polymer blend of a non-heat sealable polyolefin strength component and an elastomer heat sealable adhesive component.

13. A shielding tape as claimed in claim 12, wherein said polyolefin component is selected from the group consisting of polyethylene or polypropylene.

14. A shielding tape as claimed in claim 13 wherein said polyolefin component comprises high density polyethylene.

15. A shielding tape as claimed in claim 12, wherein said elastomeric component is selected from the group consisting of polyisoprene, polyisobutylene, or mixtures thereof.

16. A shielding tape as claimed in claim 12, wherein the surface of said foil to which the polymer supporting layer is fusibly bonded has been surface treated to render it substantially free of aluminum oxides for enhanced bonding with said polymer supporting layer.

17. A shielding tape as claimed in claim 12, wherein said aluminum foil layer is not more than about 0.003 inches thick.

18. A shielding tape as claimed in claim 14, wherein said polyolefin supporting layer is a polymer alloy comprised of a high density polyethylene, a linear low density polyethylene, and a polyisobutylene.

19. A shielding tape as claimed in claim 12 wherein said polymer supporting layer is present on one face of the shielding tape.

20. A shielding tape as claimed in claim 12 wherein said foil layer forms one face of the shielding tape, and the shielding tape includes an additional metal foil layer fusibly bonded to said polymer supporting layer and forming the opposite face of the shielding tape.

21. A metallic shielding tape useful for the preparation of shielded cable, said shielding tape comprising an aluminum foil layer and a polymer blend supporting layer fusibly bonded directly to said aluminum foil layer and serving to structurally reinforce the aluminum foil layer, the polymer blend supporting layer a comprising non-heat sealable polyolefin strength component and an elastomeric adhesive component selected from the group consisting of polyisoprene, polyisobutylene, or mixtures thereof imparting heat sealable properties to the polymer blend.

22. A shielding tape as claimed in claim 21, wherein said polyolefin strength component is selected from the group consisting of polyethylene or polypropylene.

23. A shielding tape as claimed in claim 21, wherein said polymer blend comprises high density polyethylene, linear low density polyethylene and polyisobutylene.

24. A metallic shielding tape useful for the preparation of shielded cable, said shielding tape comprising an aluminum foil layer of a thickness of no more than about 0.003 inch and heat sealable polymer blend supporting layer fusibly bonded directly to said aluminum foil layer and serving to structurally reinforce the aluminum foil layer, the polymer blend supporting layer comprising at least 40% non-heat sealable high density polyethylene, at least 1% of an elastomer selected from the group consisting of polyisoprene, polyisobutylene, or mixtures thereof, and up to 45% non-heat sealable linear low density polyethylene.

25. A cable comprising at least one metallic inner conductor, a dielectric material surrounding the at least one inner conductor, and a metallic shielding tape surrounding the dielectric material and the at least one inner conductor, said shielding tape comprising a metal foil layer and a heat sealable polymer supporting layer fusibly bonded directly to said foil layer and serving to structurally reinforce the foil layer and prevent unwanted disruptions in the foil which would adversely affect the signal propagating properties of the cable, said polymer supporting layer comprising a polymer blend of a non-polar, non-heat sealable polyolefin strength component and an elastomeric heat sealable adhesive component.

26. A cable as claimed in claim 25, wherein said non-polar, non-heat sealable polyolefin strength component comprises an unmodified polyolefin having no polar carboxyl groups.

27. A cable as claimed in claim 25, wherein said foil layer is not more than about 0.003 inches thick.

28. A metallic shielding tape useful for the preparation of shielded cable, said shielding tape comprising a metal foil layer and a heat sealable polymer supporting layer fusibly bonded directly to said foil layer and serving to structurally reinforce the foil layer and prevent unwanted disruptions in the foil which would adversely affect the signal propagating properties of the cable, said polymer supporting layer comprising a polymer blend of a non-polar, non-heat sealable polyolefin strength component and an elastomeric heat sealable adhesive component.

29. A metallic shielding tape as claimed in claim 28, wherein said non-polar, non-heat polyolefin strength component comprises an unmodified polyolefin having no polar carboxyl groups.

30. A metallic shielding tape as claimed in claim 28, wherein said foil layer is not more than about 0.003 inches thick.

* * * * *